US005326040A

United States Patent [19]

Kramer

[11] Patent Number: 5,326,040

[45] Date of Patent: Jul. 5, 1994

[54] SPHERE AND CABLE DEPLOYER

[75] Inventor: Richard E. Kramer, Damascus, Md.

[73] Assignee: Fairchild Space and Defense Corporation, Germantown, Md.

[21] Appl. No.: 51,336

[22] Filed: Apr. 23, 1993

[51] Int. Cl.[5] ..... B65H 75/40; H01Q 1/30

[52] U.S. Cl. ..... 242/390.2; 343/707; 242/418

[58] Field of Search ..... 242/54 A, 54 R, 86.5 R; 343/707; 273/360, 361

[56] References Cited

U.S. PATENT DOCUMENTS

| | | | |
|---|---|---|---|
| 2,137,450 | 11/1938 | Green | 343/707 X |
| 2,187,575 | 1/1940 | Schroder | 343/707 X |
| 2,364,637 | 12/1944 | Lear | 343/707 X |
| 3,191,880 | 6/1965 | Visconti | 242/54 R |
| 3,809,334 | 5/1974 | Beurer et al. | 242/54 R |
| 3,826,439 | 7/1974 | Moon | 242/54 R |
| 4,556,889 | 12/1985 | Buehler | 343/707 |
| 4,767,073 | 8/1988 | Malzacher | 242/54 R |

FOREIGN PATENT DOCUMENTS

| | | | |
|---|---|---|---|
| 928841 | 6/1947 | France | 343/707 |
| 989165 | 5/1951 | France | 343/707 |

*Primary Examiner*—John M. Jillions
*Attorney, Agent, or Firm*—Michael W. York

[57] ABSTRACT

A sphere and cable deployer apparatus for deploying a cable and associated sphere from a vehicle such as a satellite. The sphere and cable deployer apparatus has a drum for storing the cable that is driven by a drive shaft and gears form a drive motor to deploy the cable/sphere away. The drive motor also drives a drive roller through a series of gears and clutches that applies tension to the cable as it is being unwound from the drum. The sphere and cable deployer apparatus also has a sphere housing with two shell-like halves that pivot outward due to spring forces to release the sphere. The pivoting housing halves also provide a storage compartment for a short cable that is attached to the outer surface of the sphere. The pivoting housing halves are held in place by two cables that are under tension and associated pins that fit in holes in the housing halves and are released by cable cutters that cut the cables.

10 Claims, 2 Drawing Sheets

SPHERE AND CABLE DEPLOYER

BACKGROUND OF THE INVENTION

Spheres that are located at or near the end of a cable can have a number of uses. A typical use would be to deploy the cable and attached sphere from a vehicle. For instance, U.S. Pat. No. 4,556,889 discloses the deployment of a sphere at the end of a coaxial transmission feed line from an aircraft for use as an antenna. In this situation the cable is extended by deploying it through a suitably sized opening in the fuselage of an aircraft to trail the cable and the attached sphere behind the aircraft. As indicated in the U.S. Pat. No. 4,556,889 this antenna configuration provides an efficient antenna with very low loss that also exhibits minimal aerodynamic drag when deployed from the aircraft. The antenna is also comparatively inexpensive to manufacture.

The antenna disclosed in this patent is capable of being used both for transmitting and receiving information and it has substantially uniform transmission and reception characteristics in three dimensional space. Such features are highly desirable for both communication and surveillance.

It has also been proposed to use such a cable and sphere system with a spacecraft and in particular a spinning spacecraft that would spin cables and spheres near the outer end portions of the cables around the spinning spacecraft. Such proposed spacecraft usage presents serious problems for storing the sphere and cable system during the launch of the spacecraft and while the spacecraft is travelling to its destination in space since the spacecraft is subjected to large G loads as well as vibrations that could damage the spheres and associated structure. Such G loads and vibrations are generally not present with aircraft or at least no where near the magnitude of the G loads and vibrations that a spacecraft will experience.

The actual deployment of the cable sphere system from an aircraft is comparatively simple and a simple manually operated reel type device could be used. However, the actual deployment from a spinning spacecraft is much more complex in order to deploy the cables and attached spheres so that they are properly oriented around the spacecraft.

The sphere and cable deployer invention deploys two spheres connected to two cables and hence the previously mentioned problems are aggravated due to the complexity associated with the storage and deployment of a spheres on cables. In spite of these potential problems, the sphere and cable deployer invention is constructed to provide for the safe launch of a multiple sphere and cable system in a spacecraft and then the deployer has provision for deploying the spheres and associated cable portions outside the spacecraft as the spacecraft rotates so as to enable the spheres and cables to be properly located around the spacecraft.

BRIEF DESCRIPTION OF THE INVENTION

This invention relates to deployment apparatus for deploying spheres and the like and associated attached cable portions and more particularly to deployers for deploying spheres and associated cable portions from a vehicle.

Accordingly, it is an object of the invention to provide a sphere and cable deployer that effectively deploys or releases at least one sphere and an associated connected cable portion.

It is an object of the invention to provide a sphere and cable deployer that effectively secures the sphere and associated cable when it is not deployed.

It is an object of the invention to provide a sphere and cable deployer that is suitable for use on a vehicle.

It is an object of the invention to provide a sphere and cable deployer that is particularly suited for use on a spacecraft.

It is an object of the invention to provide a sphere and cable deployer that protects the sphere and cable from the forces exerted on a spacecraft when the spacecraft is launched.

It is an object of the invention to provide a sphere and cable deployer that houses or secures the sphere and associated cable in a compact manner.

It is an object of the invention to provide a sphere and cable deployer that takes up comparatively very little room on a spacecraft.

It is also an object of the invention to provide a sphere and cable deployer that is particularly adapted to be used to transport a spheres and associated cables within a spacecraft as the spacecraft moves in space.

It is an object of the invention to provide a sphere and cable deployer that can readily deploy a sphere and attached cable portion from spacecraft.

It is an object of the invention to provide a sphere and cable deployer that can deploy a sphere and attached cable portion so that they are properly positioned outside the spacecraft.

It is an object of the invention to provide a sphere and cable deployer that is particularly useful in deploying spheres and attached cable portions from a rotating spacecraft.

It is an object of the invention to provide a sphere and cable deployer that deploys a sphere and a plurality of and associated cable portions to provide for their accurate placement when deployed.

It is an object of the invention to provide a sphere and cable deployer that requires very little electrical power to operate.

It is an object of the invention to provide a sphere and cable deployer that places very little electrical demand upon the power supply of the spacecraft in which it is located.

It is also an object of the invention to provide a sphere and cable deployer that provides an indication of the extent of deployment of the cable and associated sphere.

It is also an object of the invention to provide a sphere and cable deployer that is capable of retracting the cable and associated sphere if desired.

It is also an object of the invention to provide a sphere and cable deployer that has provisions for locating the sphere and associated cable in space.

It is an object of the invention to provide a sphere and cable deployer that has provisions for finely adjusting the location of the sphere and associated cable in space.

It is an object of the invention to provide a sphere and cable deployer that provides an electrical signal of the extent of deployment of the cable and associated sphere so that such information can be transmitted to a remote location.

It is also an object of the invention to provide a deployer that can deploy items other than a sphere and cable.

It is an object of the invention to provide a deployer that can deploy elongated members other than cables.

These and other objects are obtained from the deploying apparatus invention for deploying an elongated member and connected objects such as a cable and a sphere that includes a storage drum for storing at least a portion of the elongated member and a housing for storing the object connected to the elongated member. The housing includes two substantially identical clam shell like halves that are hinged together at one end and are biased by springs in an outward direction. The invention also includes release means for controlling the opening of the housing to release the object such as a sphere that is connected to the elongated member. The release means includes two pins that secure the clam shell like halves together when the sphere is in the stowed position, two cables that are connected to the pins and hold the pins in place and cable cutters that cut the cables to release the pins and the clam shell like halves. The deploying apparatus also has means for indicating the extent of the deployment of the cable or other elongated member.

BRIEF DESCRIPTION OF THE DRAWINGS

The invention will be hereinafter more fully described with reference to the accompanying drawings in which.

DETAILED DESCRIPTION OF THE PREFERRED EMBODIMENTS

Figure 1:
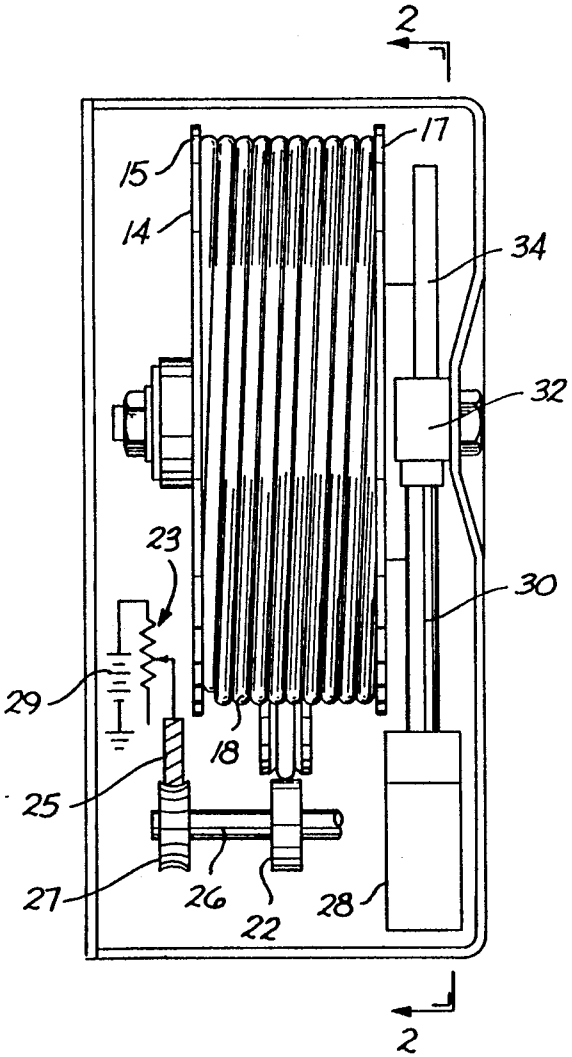
FIG. 1 is an end elevational view of the deploying apparatus invention.
Figure 2:
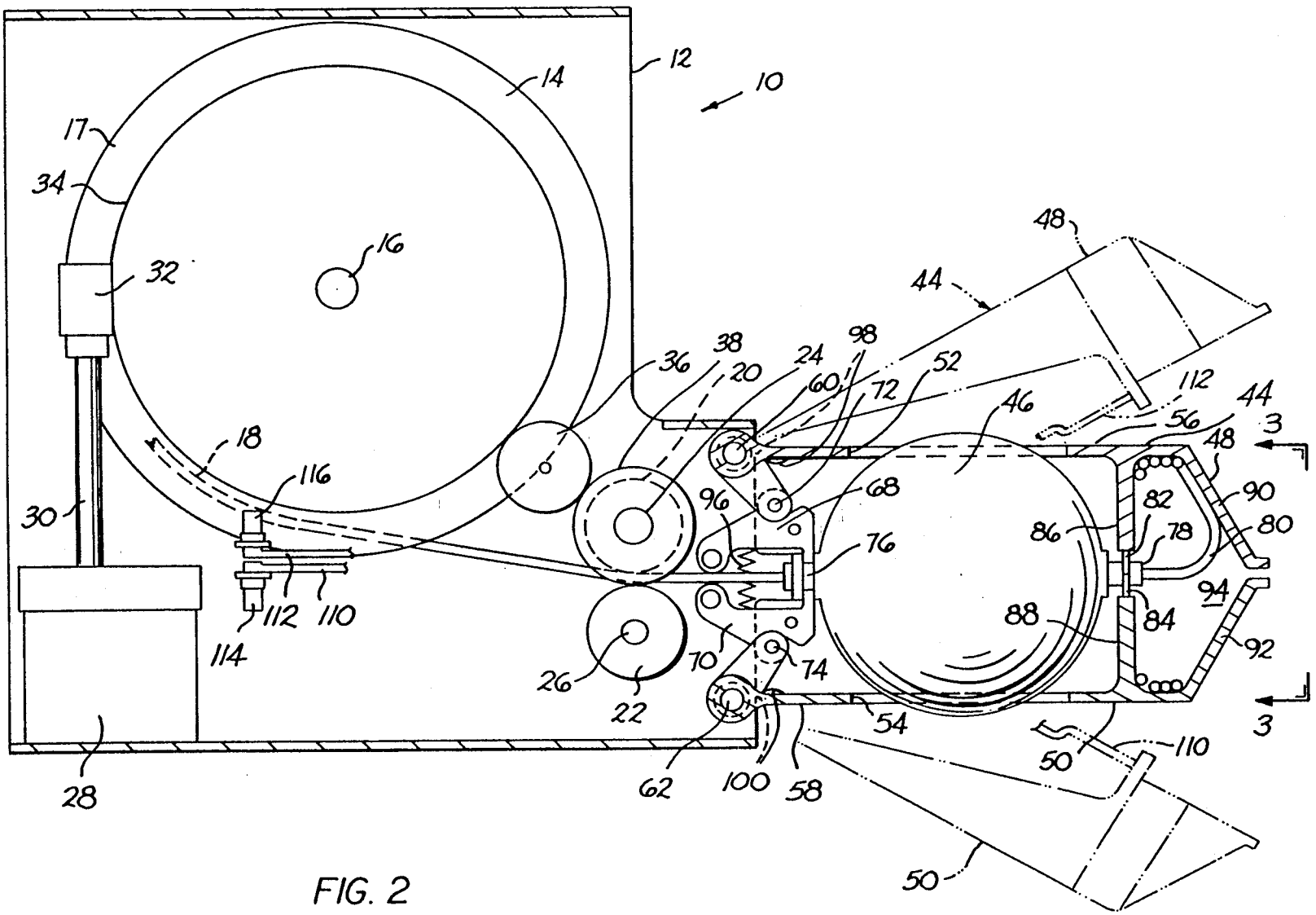
FIG. 2 is a sectional view of the deploying apparatus invention illustrated in FIG. 1 taken substantially on the line 2—2 thereof with certain parts illustrated in phantom lines to show their alternate positions.

The deploying apparatus invention is illustrated in FIGS. 1 and 2 and is designated generally by the number 10. The deploying apparatus 10 comprises a substantially rectangular shaped housing 12, a generally cylindrical shaped storage spool 14 with its outer flanges 15 and 17 that is horizontally mounted within the housing 12 on a horizontal shaft 16 for storing an elongated member comprising a cable 18 that is stored by being wound around the outside surface of the storage spool 14 and a drive roller 20 and associated pressure roller 22 that are horizontally mounted within the housing 12 on the respective shafts 24 and 26 that are used to pull the cable 18 off of the storage spool 14. A potentiometer 23 is connected to the back up roller 22 through a worm 25 and a worm gear 27 that rotates on the shaft 26 that is also secured to and rotates with the back up roller 22 and this permits the determination of the amount of deployed cable 18 due to the rotation of the back up roller 22 and associated change in resistances of the potentiometer 23. Electrical power for the potentiometer 23 is supplied by the connected battery 29.

The deploying apparatus 10 also includes a drive motor 28 and associated drive shaft 30 and gear 32 that meshes with an associated gear 34 that is rigidly connected to the end of the storage spool 14 so that activation of the drive motor 28 causes rotation of the drive shaft 30, the gear 32 and the associated gear 34 and the attached storage spool 14.

As illustrated in FIG. 2, the drive motor 28 also drives the drive roller 20 through the idler gear 36 and associated slip clutch drive gear 38 that drives a friction slip clutch that drives the shaft 24 that drives a one way drive clutch located inside the drive roller 20. The choice of the gear size should be such that the drive roller 20 rotates in a manner that it puts tension on the cable 18 since it is desirable to pull or remove the cable 18 from the storage spool 14 faster than the gears 32, 34 and the associated drive motor 28 want to rotate the storage spool 14. This is done to prevent slack in the cable 18 as the effective diameter of the coiled cable changes as the cable is unwound or wound on the storage spool 14.

The deploying apparatus invention 10 also comprises a storage housing 44 for storing a sphere 46 that is rigidly attached to the outer end portion of the cable 18. The storage housing 44 comprises two substantially identical clam shell like halves 48 and 50. Each half, 48 and 50, has respective holes 52 and 54 in its outer walls 56 and 58 that are sized to permit a portion of the sphere 46 to extend through them when the halves 48 and 50 are in their closed or stowed positions. The halves 48 and 50 are pivotally mounted on the respective hinge pins 60 and 62 that are connected to the respective link members 64 and 66 that are in turn pivotally connected to respective support clamps 68 and 70 by the respective pivot pins 72 and 74.

These clamps 68 and 70 have jaws that are sized and shaped to grip a cylindrical engaging member 76 located around the cable 16 at a point where the cable 16 enters the inner surface of the sphere 46. Another cylindrical engaging member 78 is located around a short length of a cable 80 that projects from the opposite side of the sphere 46 and adjacent the outer surface of the sphere 46. This engaging member 78 is engaged by recesses 82 and 84 in respective inner walls 86 and 88 located in the respective halves 48 and 50 when the halves 48 and 50 are in their stowed or closed positions. These walls 86 and 88 and the associated outer walls 90 and 92 form a compartment 94 for the stowed cable end portion 80 when the halves 48 and 50 are in their closed positions.

Figure 3:
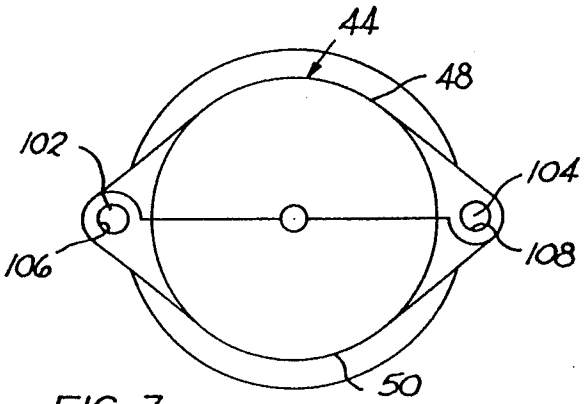
FIG. 3 is an enlarged view of a portion of the deploying apparatus structure illustrated in FIG. 2 taken substantially in the direction of the line 3—3 thereof.

A compression spring 96 that is located between the clamps 68 and 70 biases these clamps in an outward direction and coil springs 98 and 100 that are located around the respective pins 60 and 62 that also engage the respective halves 48 and 50 tend to rotate these halves 48 and 50 in an outward direction. However, normally, as illustrated in FIG. 3, the halves 48 and 50 are secured together by the respective release pins 102 and 104 located in the respective holes 106 and 108. These pins 102 and 104 prevent the halves 48 and 50 from moving outward when the halves 48 and 50 are in their stowed positions. These pins 102 and 104 are connected to the respective cables 110 and 112 that in turn are connected to pyrotype cable cutters 114 and 116 that cut the respective cables 110 and 112 that then activate or remove the pins 102 and 104 to cause the halves 48 and 50 to move outward as a result of the forces exerted by the springs 96, 98 and 100.

The deploying apparatus invention 10 is manufactured in the following manner. The housing 12 is manufactured from metallic sheet materials and/or from combined metallic and composite sheet materials and spacers through techniques known in the art. The drum member 14 can be fabricated using known techniques from a suitable combination of metallic or composite materials. The rollers 20 and 22 and the housing 44 can be manufactured from fiber glass or aluminum using techniques known in the art. The sphere 46 should be manufactured using known techniques from a non-magnetic material which could be aluminum. The clamps 68 and 70 and also the link members 64 and 66 should also be made from a non-conductive, non-metallic material through the use of known techniques. The motor 28, the worm 25, the worm gear 27, the shaft 26, the drive shaft 30 and associated gears 32, 34, 36 and 38 as well as the potentiometer 23 are conventional items known in the art. The other components including the cable 18 are basic items known in the art.

Figure 4:
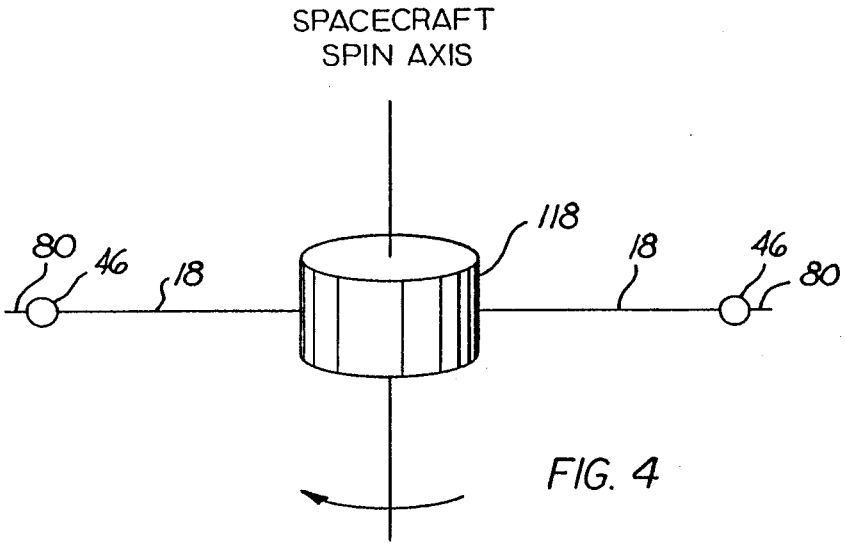
FIG. 4 is a perspective view illustrating the deploying apparatus invention in use on a spacecraft with cables and spheres deployed.

The deploying apparatus invention 10 is used in the following manner. When the vehicle such as the spacecraft 118 illustrated in FIG. 4, is located at the desired location in space, the cable cutters 114 and 116 are activated by means known in the art that do not form part of the invention to cut the respective cables 110 and 112. When these cables 110 and 112 that are under tension are cut this causes the connected pins to 102 and 104 to leave their respective holes 106 and 108. As a result, the clam shell like housing halves 48 and 50 move outward as illustrated by the phantom lines in FIG. 2 due to the action of the springs 96, 98, and 100 and this frees the sphere 46 and cable 80.

The drive motor 28 is then activated in a conventional manner and through the action of the drive shaft 30, gears 32 and 34, idler gears and frictional clutch 40 and the drive roller 20 and associated pressure roller 22 this causes the cable 18 to be pulled off of the drum 14. Tension is maintained on the cable 18 as it is unwound from the drum 14. In view of the potentiometer 23 connected to the back up roller 22 the exact amount of the cable 18 that has been deployed can be determined and hence the amount of cable 18 that is deployed can be accurately controlled. When the cable 18 is deployed to the desired length, then the drive motor would be shut off.

Usually one or more pairs of two deploying apparatus 10 would be used on a single spacecraft 118 as illustrated in FIG. 4. This results in two cables 18, connected spheres 46 and the short cables 80 being deployed from opposite sides of the spacecraft 118 that in most cases would be spinning about its spin axis. Typically the cables 18 would be deployed for approximately some fifty meters outside the spacecraft 118 and the outer cables 80 would extend approximately an additional one meter beyond the spheres 46. Normally, although they may be partially retracted by reversing the drive motor 28 direction of operation, once the cables 18 and associated spheres 46 and the outer short cables 80 are deployed they will not be fully retracted and hence there is no provision for reclosing the halves 48 and 50 of the storage housing 44.

Although the invention has been described in considerable detail with reference to a certain preferred embodiment, it will be understood that variations or modifications may be made within the spirit and scope of the invention as defined in the appended claims.

What is claimed is:

1. Sphere and cable deploying apparatus comprising a cable member, a spherical member connected to said cable member, a storage drum for storing at least a portion of said cable member with at least a portion said cable member being wound on said drum, means operatively associated with said cable member for applying tension to said cable member as said cable member is being unwound from said storage drum, and a housing including releasable storage means for releasably storing said spherical member in an undeployed configuration and means for opening said releasable storage means for releasably storing said spherical member.

2. The sphere and cable deploying apparatus of claim 1 further comprising means for driving said storage drum.

3. The sphere and cable deploying apparatus of claim 1 wherein said means for releasably storing said spherical member also comprises means for protecting said spherical member.

4. The sphere and cable deploying apparatus of claim 1 further comprising a second cable member connected to said spherical member.

5. The sphere and cable deploying apparatus of claim 4 further comprising means for releasably storing said second cable member.

6. The sphere and cable deploying apparatus of claim 1 further comprising means for activating said opening means.

7. The sphere and cable deploying apparatus of claim 6 wherein said activating means comprises at least one release cable and means for cutting said release cable.

8. The sphere and cable deploying apparatus of claim 6 further comprising means for partially retracting said cable member.

9. The sphere and cable deploying apparatus of claim 6 further comprising means associated with said cable member for indicating the deployment of said cable member.

10. The sphere and cable deploying apparatus of claim 9 wherein said means for indicating the deployment of said cable comprises means for indicating the extent of deployment of said cable member.

* * * * *